US009889062B2

(12) United States Patent
Chen

(10) Patent No.: US 9,889,062 B2
(45) Date of Patent: Feb. 13, 2018

(54) EXTENSIBLE DEVICE CAPABLE OF SWITCH, CONTROL, POWER AND CONNECTION

(71) Applicant: Jue-Yao Chen, Taichung (TW)

(72) Inventor: Jue-Yao Chen, Taichung (TW)

( * ) Notice: Subject to any disclaimer, the term of this patent is extended or adjusted under 35 U.S.C. 154(b) by 378 days.

(21) Appl. No.: 14/722,188

(22) Filed: May 27, 2015

(65) Prior Publication Data

US 2016/0346152 A1 Dec. 1, 2016

(51) Int. Cl.

| | |
|---|---|
| ***A61H 23/00*** | (2006.01) |
| ***A61H 7/00*** | (2006.01) |
| ***A61H 23/02*** | (2006.01) |

(52) U.S. Cl.

CPC ..... *A61H 7/007* (2013.01); *A61H 23/006* (2013.01); *A61H 23/02* (2013.01); *A61H 2201/1207* (2013.01); *A61H 2201/1246* (2013.01); *A61H 2201/149* (2013.01); *A61H 2201/1436* (2013.01); *A61H 2201/1463* (2013.01); *A61H 2201/1669* (2013.01)

(58) Field of Classification Search

CPC ..... A61H 7/007; A61H 23/006; A61H 23/02; A61H 2201/1207; A61H 2201/1246; A61H 2201/1436; A61H 2201/1463; A61H 2201/149; A61H 2201/1669

USPC ..... 601/100

See application file for complete search history.

(56) References Cited

U.S. PATENT DOCUMENTS

| | | | | |
|---|---|---|---|---|
| 6,551,259 | B1 * | 4/2003 | Wu | A61H 37/00 601/101 |
| 7,976,485 | B2 * | 7/2011 | Huang | A61H 15/0078 601/100 |
| 8,182,436 | B2 * | 5/2012 | Zhong | A61H 7/004 601/115 |
| 8,282,585 | B2 * | 10/2012 | Ding | A61H 7/007 601/126 |
| 2005/0256434 | A1 * | 11/2005 | Luo | A61H 15/00 601/86 |
| 2006/0211962 | A1 * | 9/2006 | Ferber | A61H 7/004 601/86 |
| 2007/0106185 | A1 * | 5/2007 | Ferber | A61H 7/007 601/86 |
| 2007/0239090 | A1 * | 10/2007 | Mitea | A61H 15/0078 601/112 |
| 2016/0136040 | A1 * | 5/2016 | Li | A61H 23/0263 601/160 |

FOREIGN PATENT DOCUMENTS

| | | |
|---|---|---|
| TW | M454833 U | 6/2013 |
| TW | I430786 B | 3/2014 |
| TW | I437983 B | 5/2014 |

* cited by examiner

*Primary Examiner* — Andrew S Lo
(74) *Attorney, Agent, or Firm* — Alan D. Kamrath; Kamrath IP Lawfirm, P.A.

(57) ABSTRACT

An extensible device capable of switch, control, power and connection includes a signal receiving device adapted to receive a control signal and electrically connected to a small power source to control the small power source. The small power source is power-connected to an extensible structure. The extensible structure includes a transmission gear train, whereby a massage device, coupled with one reinforced motor, controllably effects a plurality of massage techniques in conjunction with the at least one extensible device.

16 Claims, 16 Drawing Sheets

EXTENSIBLE DEVICE CAPABLE OF SWITCH, CONTROL, POWER AND CONNECTION

BACKGROUND OF THE INVENTION

1. Technical Field

The present invention relates to the field of massage equipment and, more particularly, to an extensible device capable of switch, control, power and connection and characterized in that its massage device only requires one reinforced motor adapted to controllably effect a plurality of massage techniques in conjunction with at least one extensible device.

2. Description of Related Art

Taiwan Patent 101104153, entitled Massage device capable of two-dimensional movement, is directed to a massage device comprising a first reinforced motor and a second reinforced motor. The first reinforced motor provides lateral movement-oriented power and massage-oriented power. The second reinforced motor provides vertical movement-oriented power. However, a conventional reinforced motor incurs high cost, not to mention two reinforced motors. Hence, there is still room for improvement in Taiwan Patent 101104153.

Taiwan Patent 101114000 is entitled Massage device capable of lateral and vertical tapping. Taiwan Patent 102202905 is entitled Massager capable of synchronous kneading and tapping. Both require at least two reinforced motors. Hence, the prior art most requires multiple reinforced motor massagers and thus still has room for improvement.

Three reinforced motors are required to allow conventional massage parts and components to perform six functions, namely synchronous kneading/swinging/tapping or single fixed-point kneading/swinging/tapping. However, the conventional three reinforced motors incur high cost. Furthermore, the conventional three reinforced motors operate synchronously and thus produce noise.

SUMMARY OF THE INVENTION

It is an objective of the present invention to provide an extensible device capable of switch, control, power and connection, and comprising a massage device which only requires one reinforced motor adapted to controllably effect a plurality of massage techniques in conjunction with the at least an extensible device.

In order to achieve the above and other objectives, the present invention provides an extensible device capable of switch, control, power and connection and comprises at least one extensible device and a massage device. Each extensible device comprises a signal receiving device adapted to receive a control signal and electrically connected to a small power source to control the small power source, with the at least one extensible device each having an extensible structure. The extensible structure is power-connected to the small power source and comprises an extensible transmission rod, and a transmission gear train is fixed to the extensible transmission rod. The massage device, coupled with one reinforced motor, controllably effects a plurality of massage techniques in conjunction with the at least one extensible device.

BRIEF DESCRIPTION OF THE DRAWINGS

Objectives, features, and advantages of the present invention are hereunder illustrated with preferred embodiments in conjunction with the accompanying drawings, in which.

DETAILED DESCRIPTION OF THE EMBODIMENT EMBODIMENTS OF THE INVENTION

Figure 1:
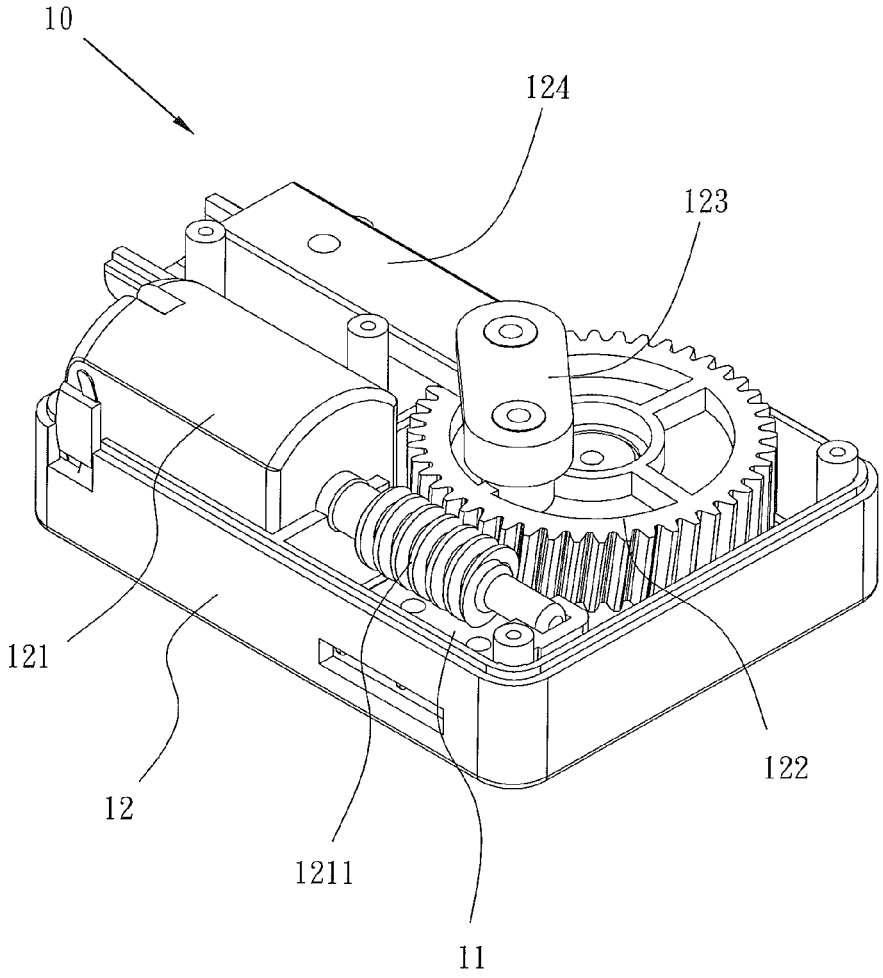
FIG. 1 is a perspective view of an extensible device according to an embodiment of the present invention.
Figure 2:
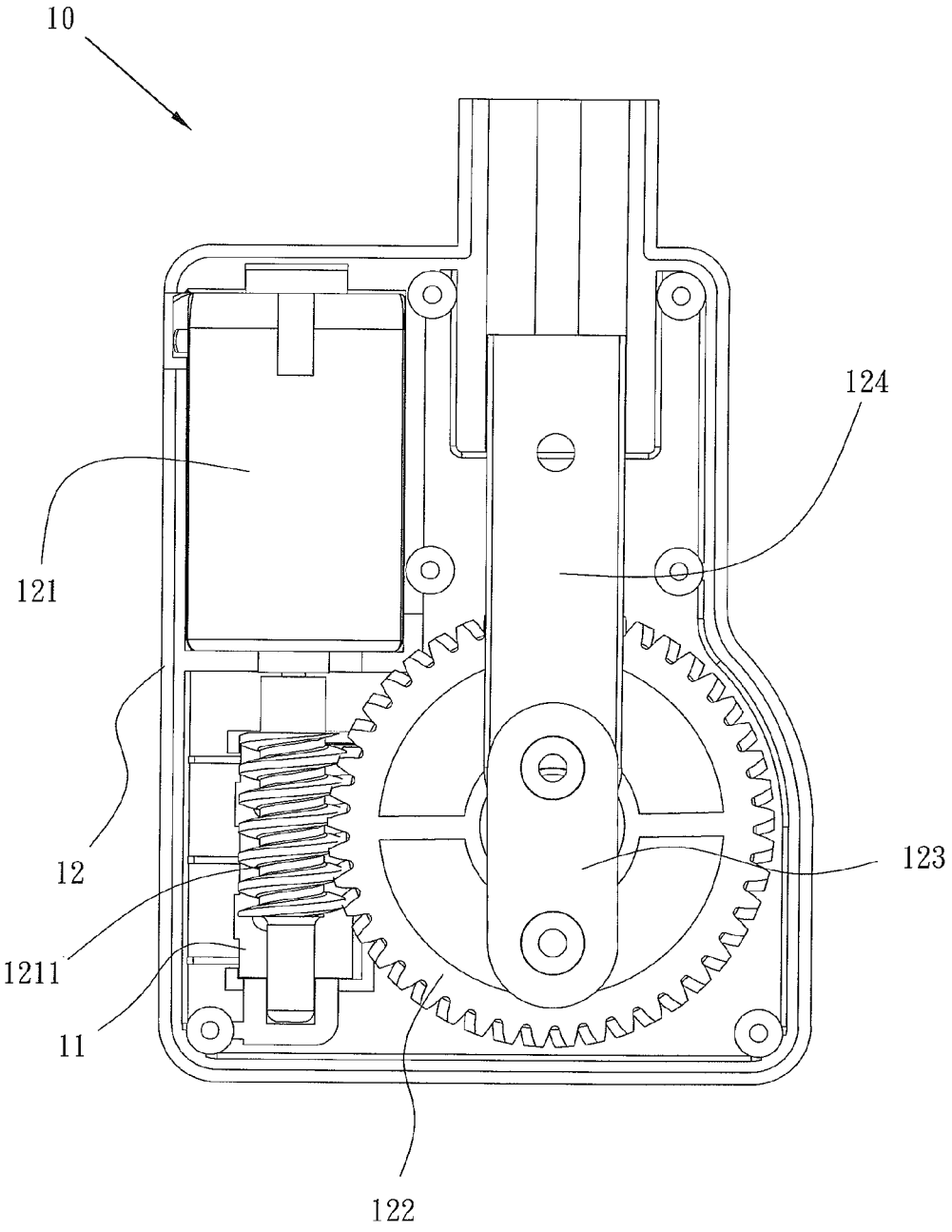
FIG. 2 is a top view of the extensible device according to the embodiment of the present invention, showing that a lever is pulled to its lowest limit.
Figure 3:
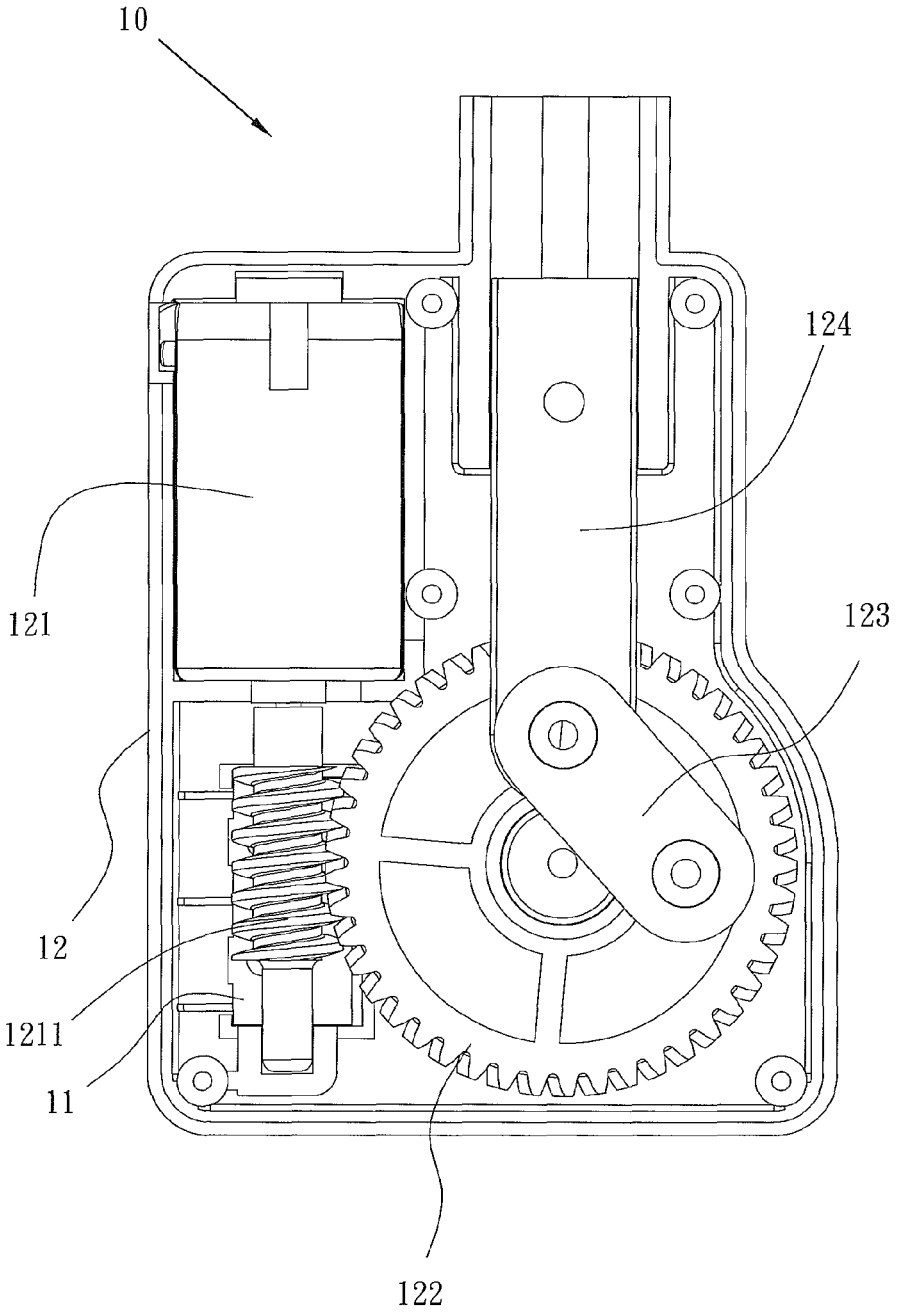
FIG. 3 is a top view of the extensible device according to the embodiment of the present invention, showing that the lever is half pushed out.
Figure 4:
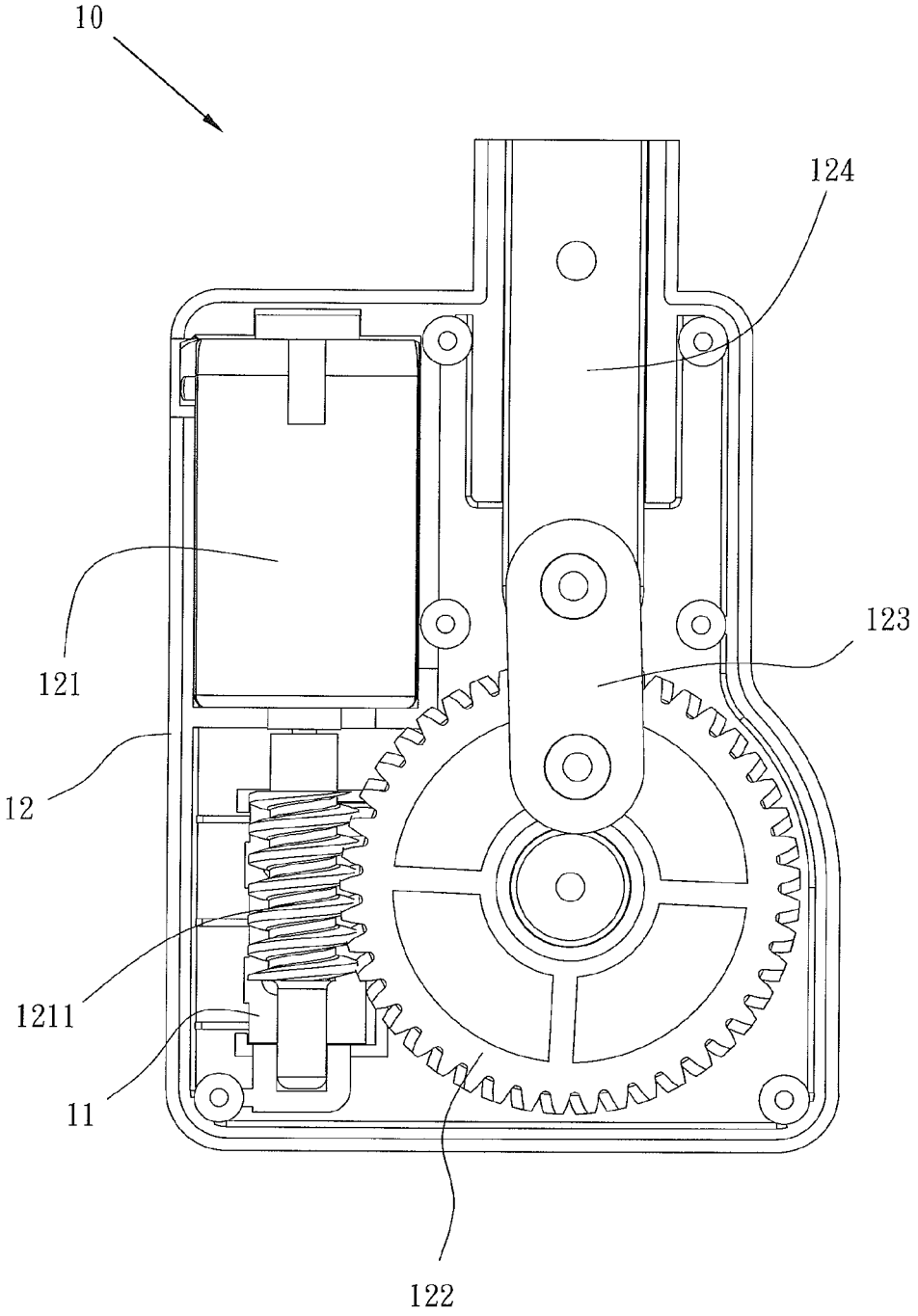
FIG. 4 is a top view of the extensible device according to the embodiment of the present invention, showing that the lever is fully pushed out.
Figure 5:
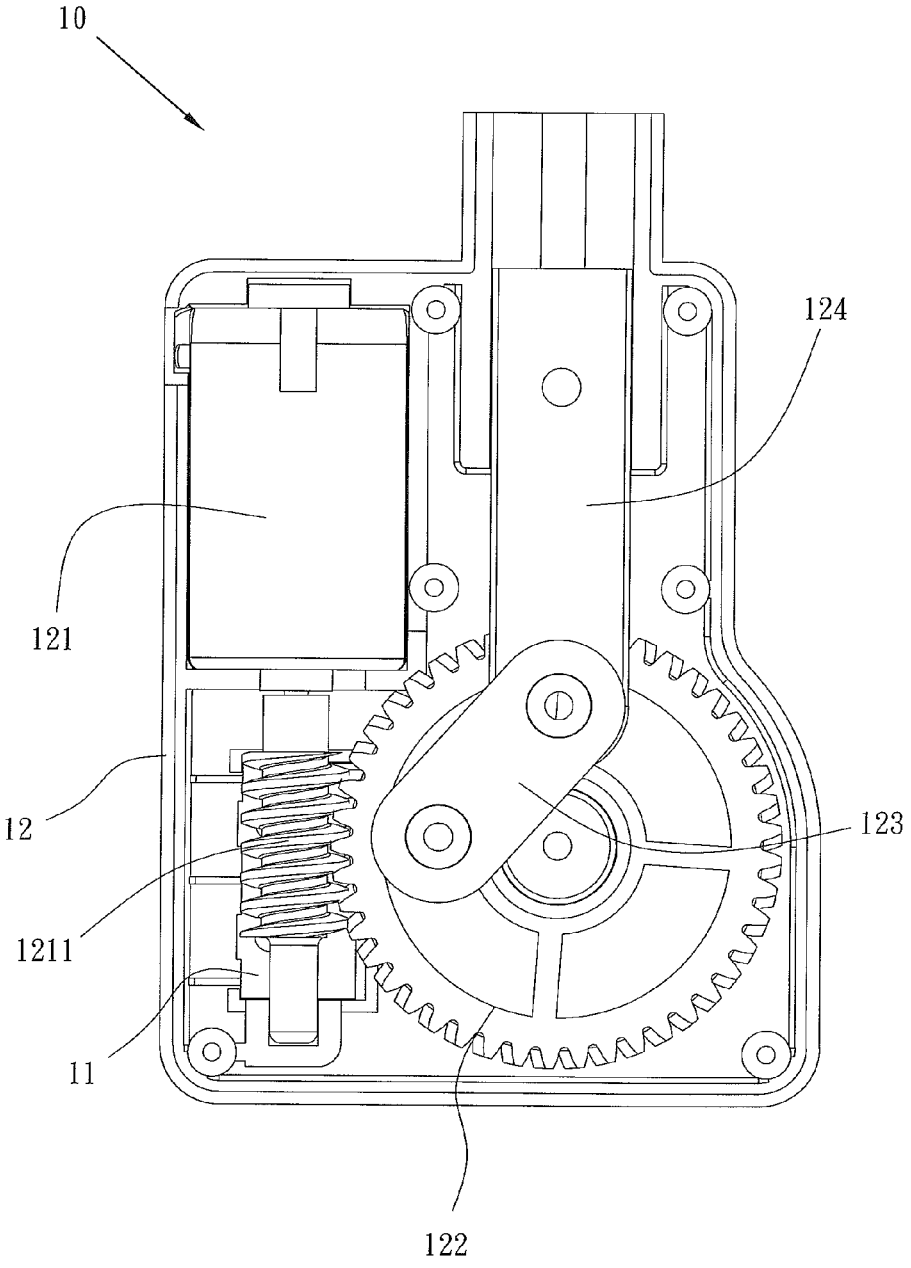
FIG. 5 is a top view of the extensible device according to the embodiment of the present invention, showing that the lever is half pulled back.
Figure 6:
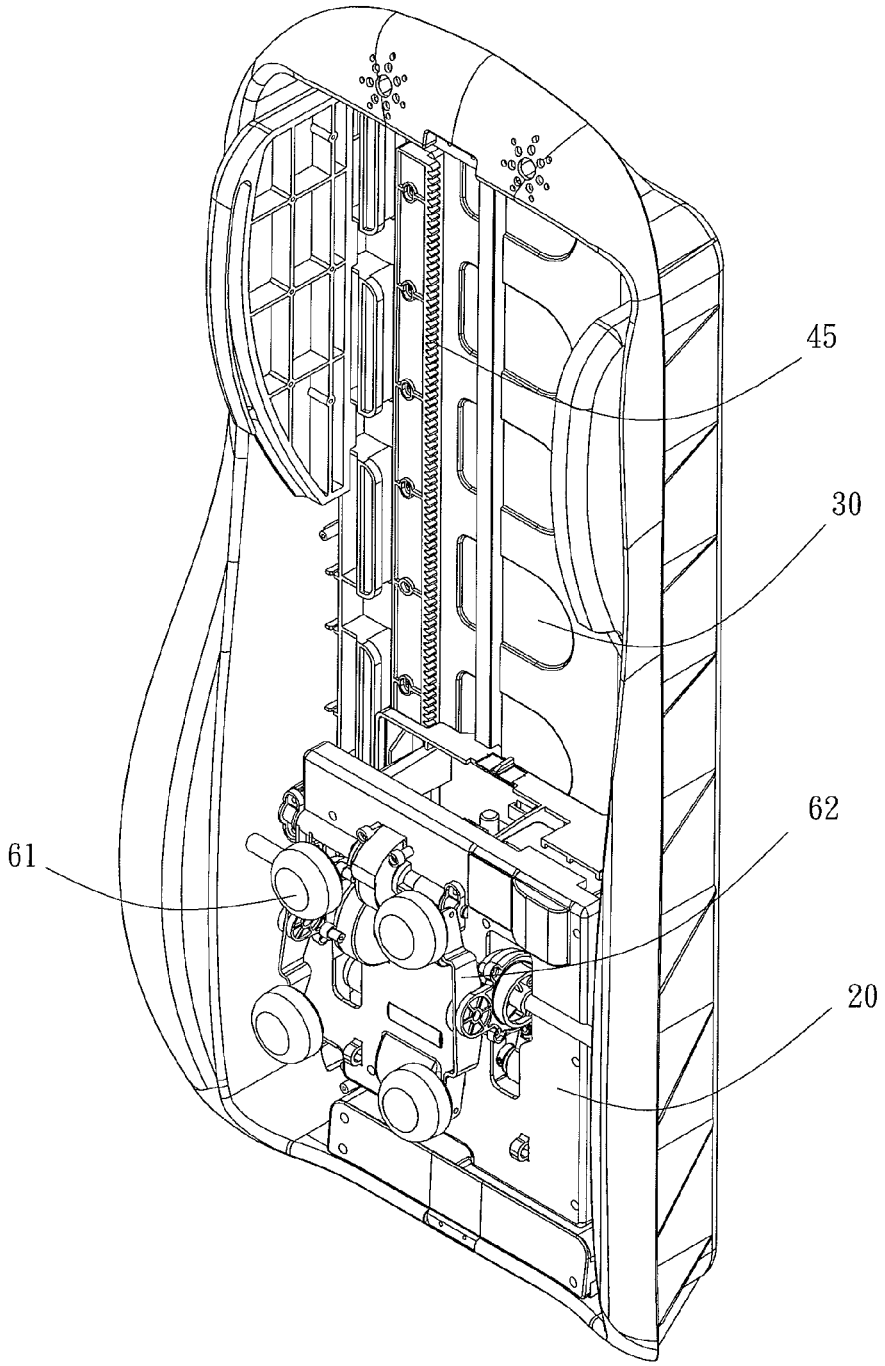
FIG. 6 is a perspective view of a massage device in its entirety and a casing according to the present invention.
Figure 7:
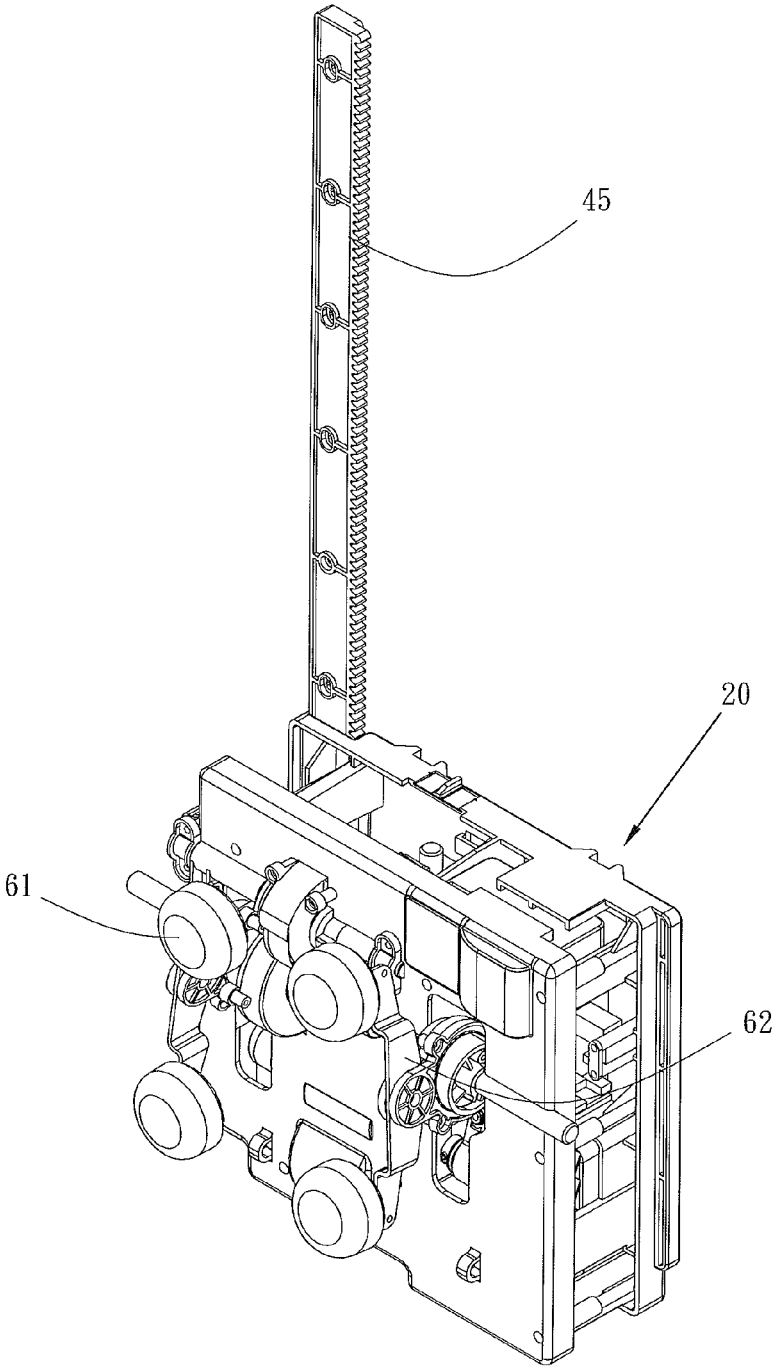
FIG. 7 is a perspective view of the massage device in its entirety according to the present invention.
Figure 8:
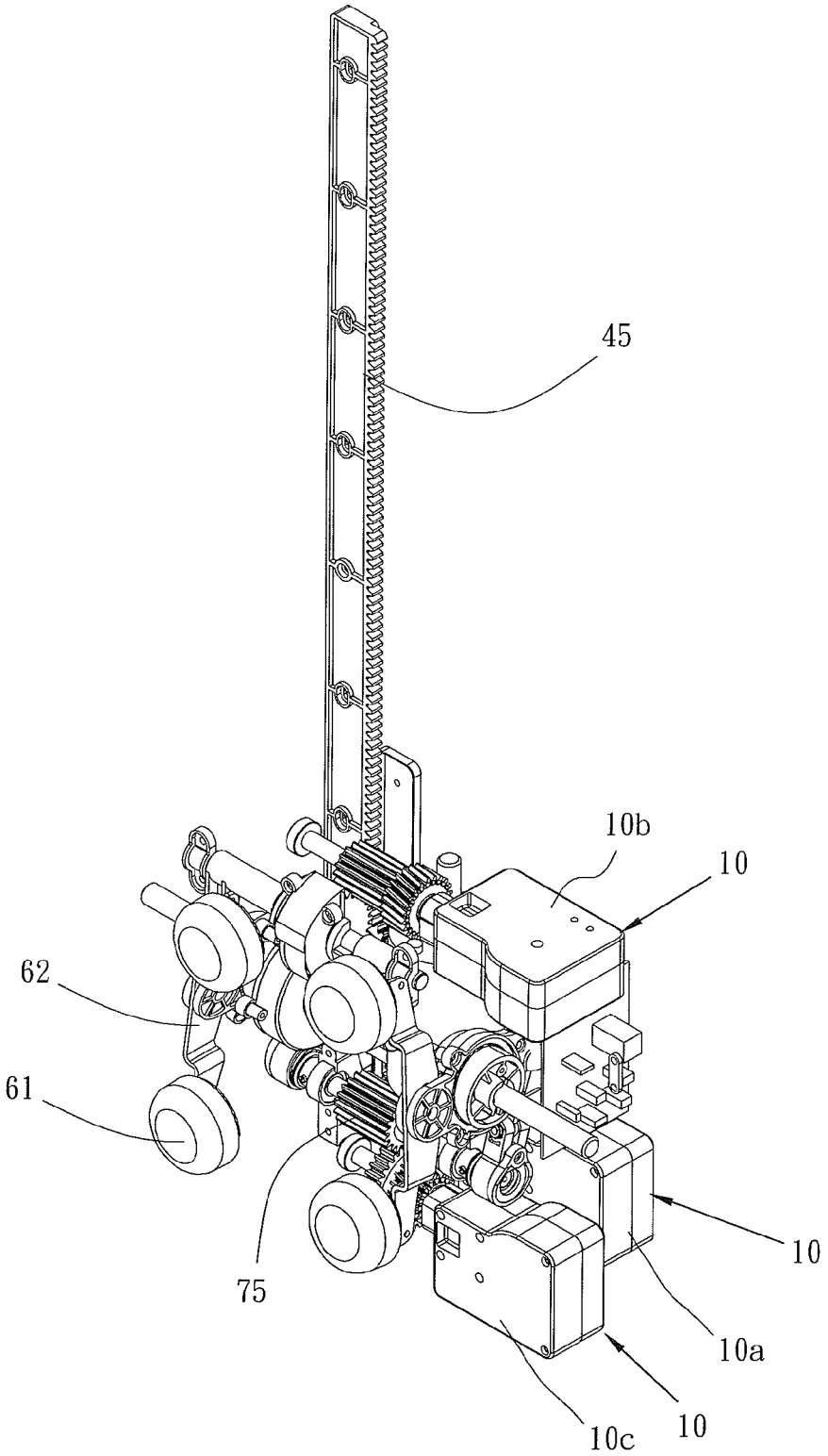
FIG. 8 is a perspective view of the massage device with the casing removed according to the present invention.
Figure 9:
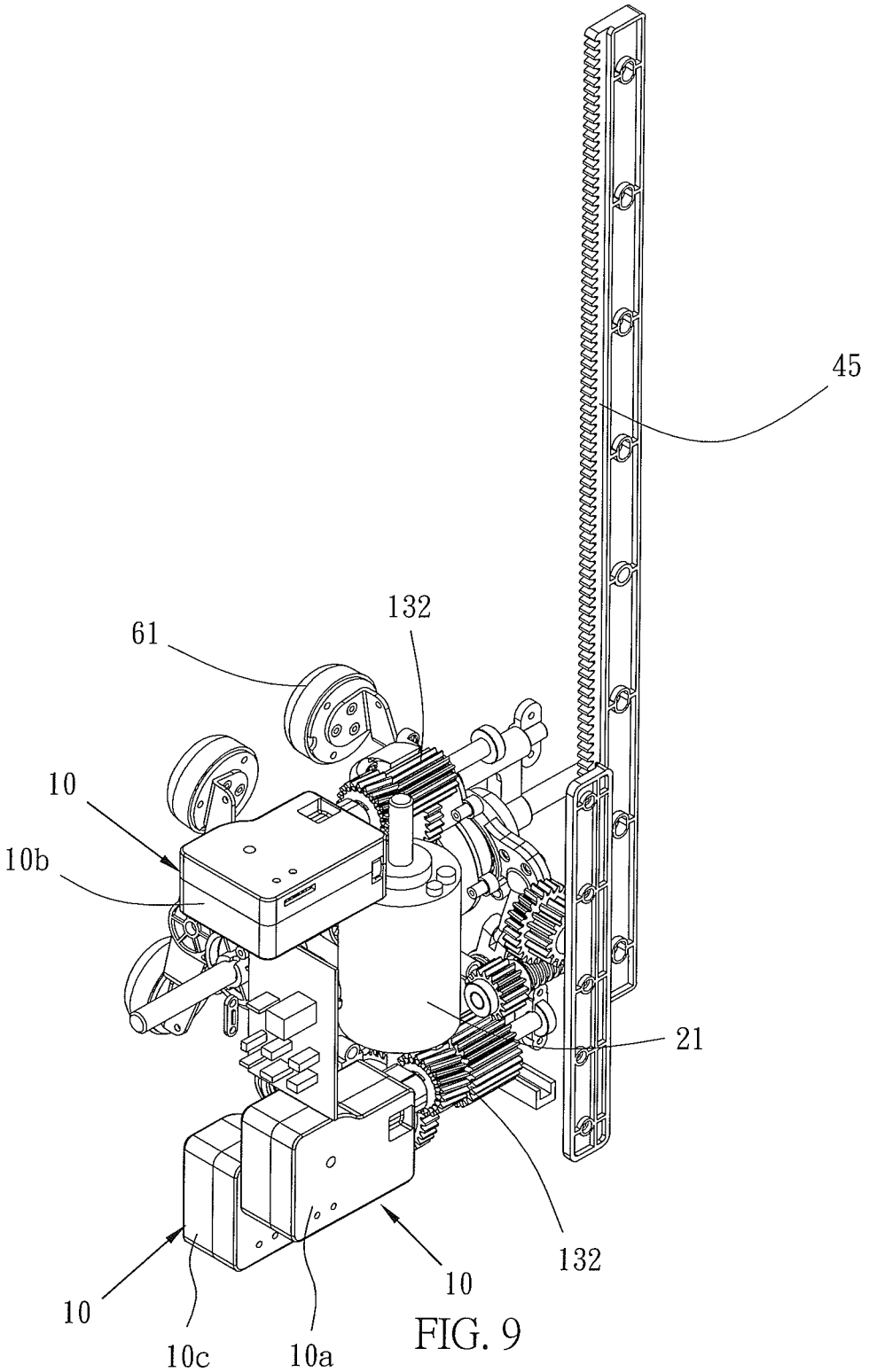
FIG. 9 is a rear perspective view of the massage device with the casing removed according to the present invention.
Figure 10:
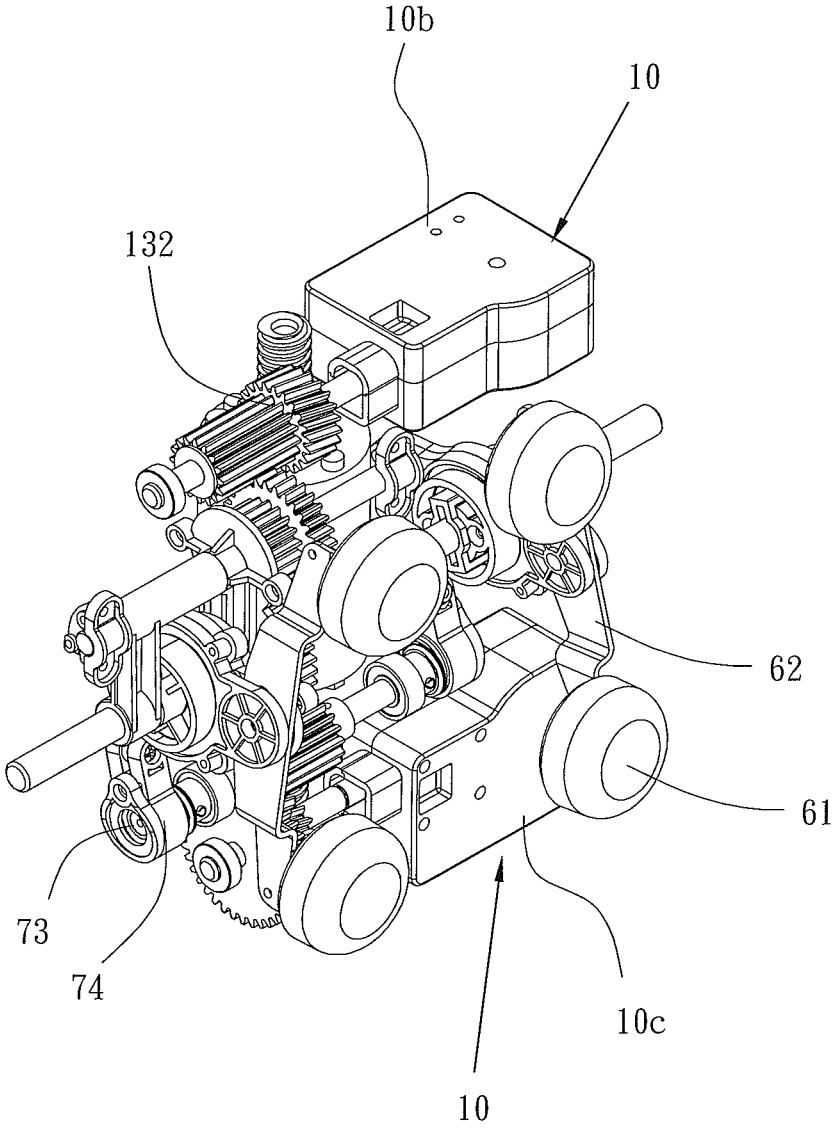
FIG. 10 is a perspective view of the massage device according to the present invention, showing that the casing and a vertical displacement structure having been removed.
Figure 11:
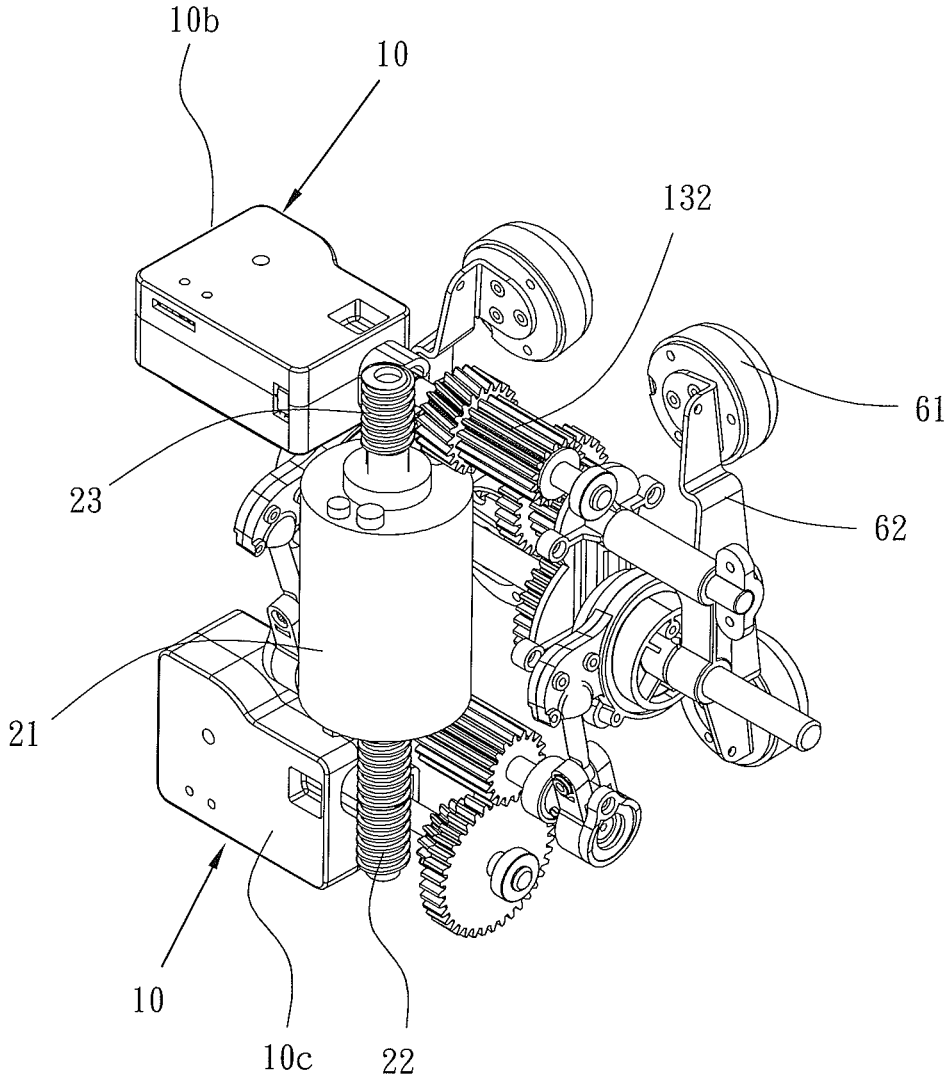
FIG. 11 is a rear perspective view of the massage device according to the present invention, showing that the casing and the vertical displacement structure having been removed.
Figure 12:
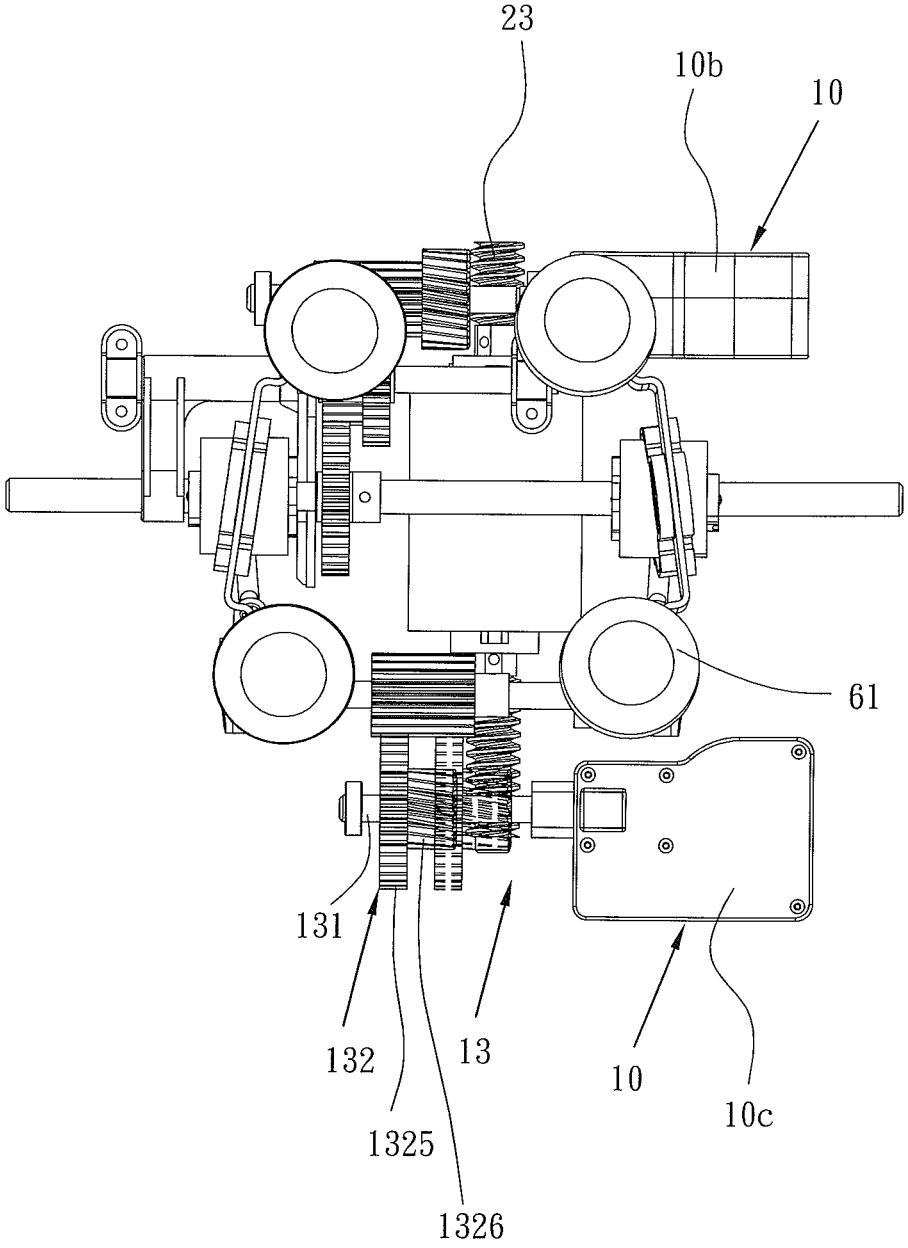
FIG. 12 is a schematic view of the operation of the third extensible device according to the present invention.
Figure 13:
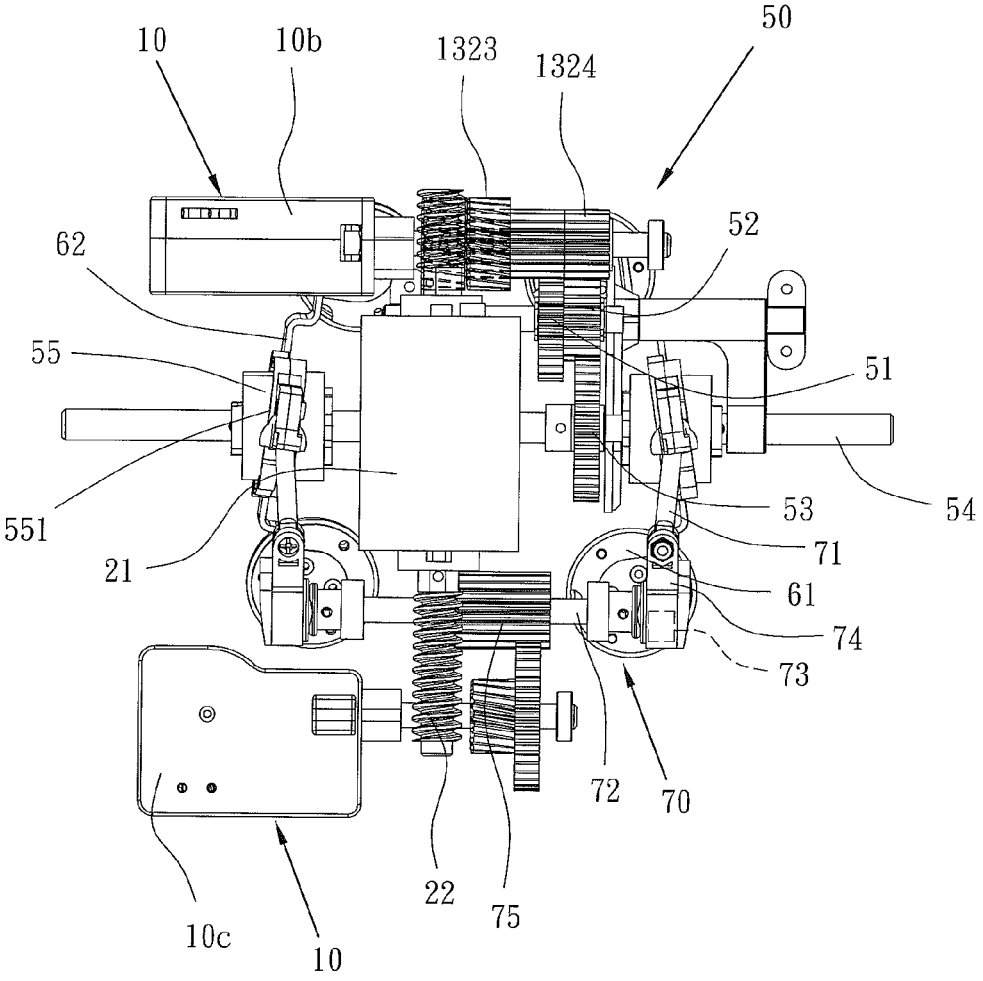
FIG. 13 is a schematic view of the operation of the second extensible device according to the present invention.

Referring to FIG. 1 through FIG. 16, the present invention provides an extensible device capable of switch, control, power and connection and comprises at least one extensible device 10 and a massage device 20.

The at least one extensible device 10 each comprises a signal receiving device 11, a small power source 12, and an extensible structure 13. The signal receiving device 11 receives a control signal. The signal receiving device 11 is electrically connected to the small power source 12 to control the small power source 12. The small power source 12 is power-connected to the extensible structure 13. The extensible structure 13 comprises an extensible transmission rod 131, and a transmission gear train 132 is fixed to the extensible transmission rod 131.

The massage device 20 only requires one reinforced motor 21. The reinforced motor 21 is adapted to controllably effect a plurality of massage techniques in conjunction with the at least one extensible device 10.

In an embodiment of the present invention, the small power source 12 comprises a small motor 121, a small gear 122, a crank 123 or a cam and a lever 124. The small motor 121 has a worm gear 1211 for driving the small gear 122.

The small gear 122 drives the crank 123 or the cam. The crank 123 drives the lever 124. The lever 124 drives the extensible transmission rod 131.

In another embodiment of the present invention, the small power source. 12 is a small motor for driving a worm drive. A cord has one end fixed to the worm drive and the other end fixed to the extensible transmission rod 131. The extensible transmission rod 131 is pushed outward with a spring. The small motor operates and enables the cord to be wound inward and thereby pulling the extensible transmission rod 131 inward.

The small power source 12 further comprises a solenoid valve and a solenoid valve shaft. The solenoid valve operates to push and pull the solenoid valve shaft, and, then, the solenoid valve shaft pushes and pulls the extensible transmission rod 131.

In yet another embodiment of the present invention, the small power source 12 is a hydraulic cylinder or a pneumatic cylinder each adapted to push and pull the extensible transmission rod 131.

Figure 14:
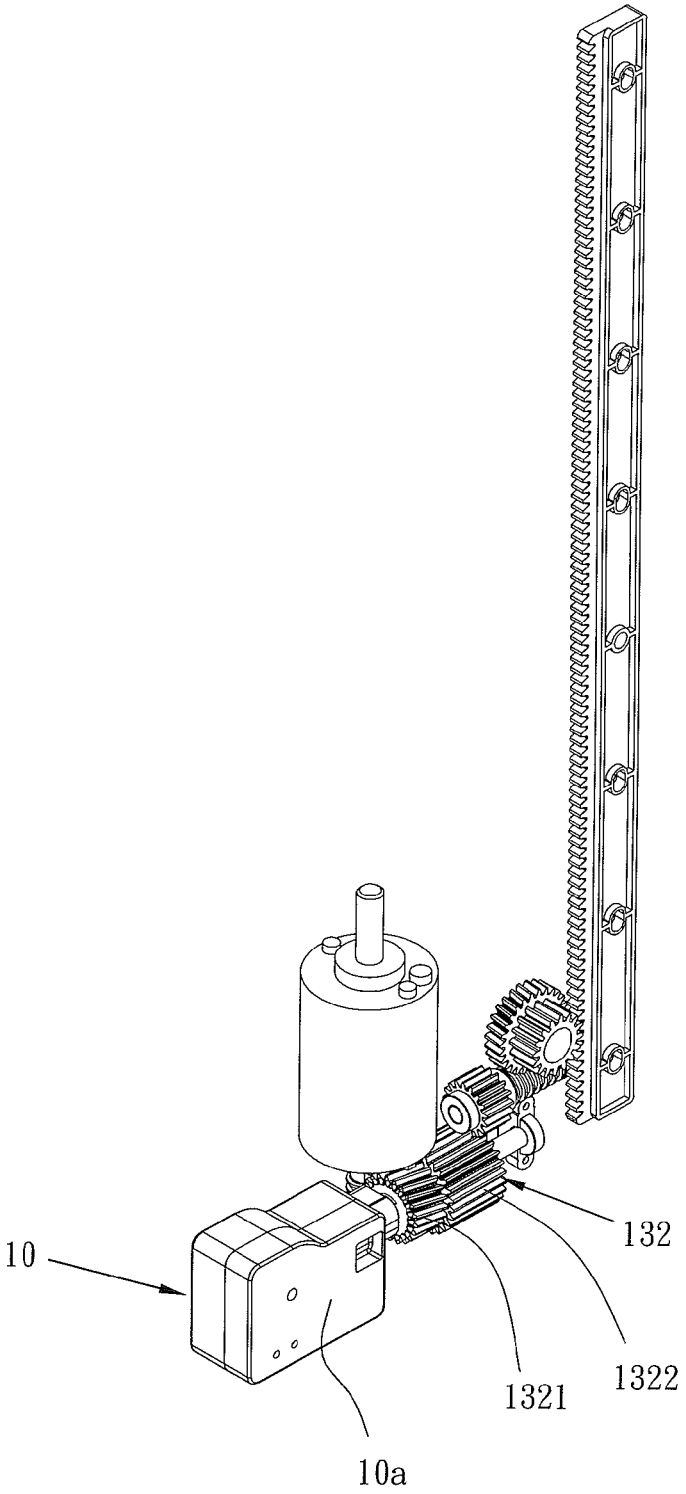
FIG. 14 is a partial rear perspective view of the vertical displacement structure according to the present invention.
Figure 15:
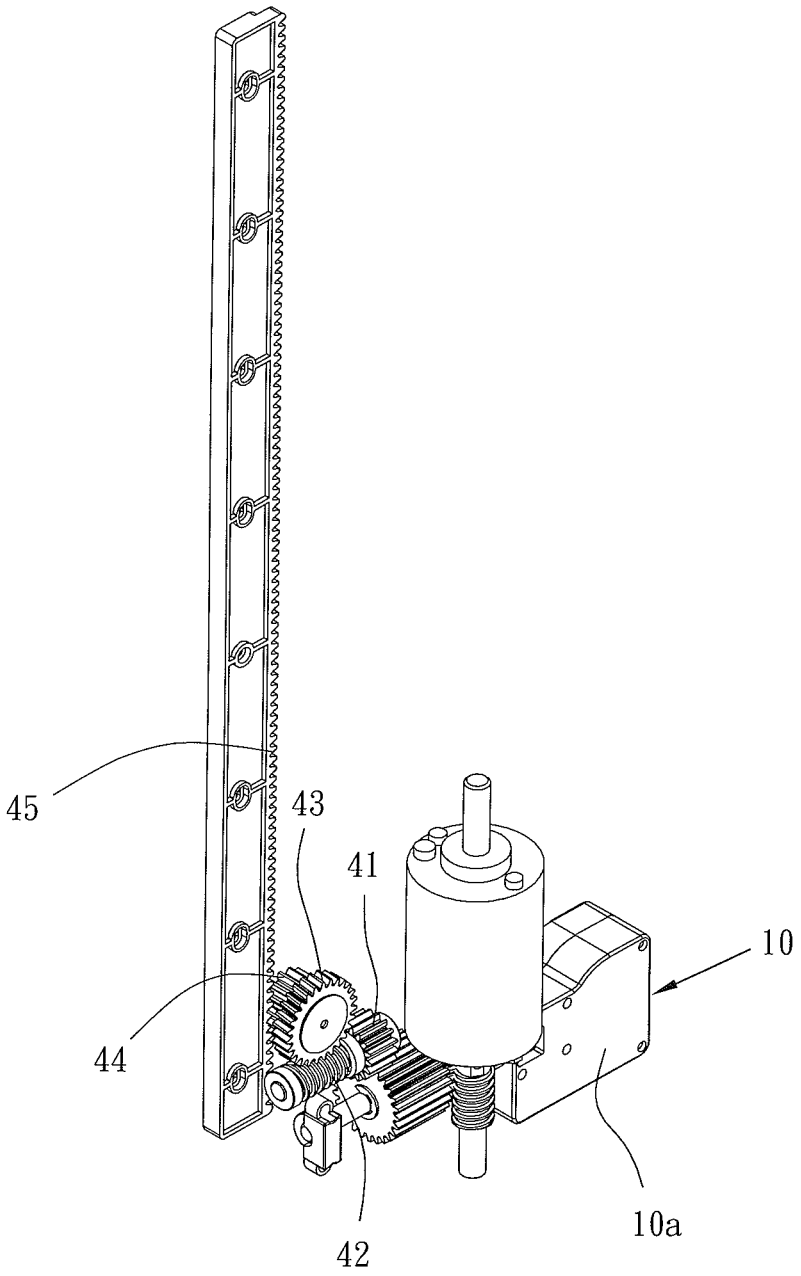
FIG. 15 is a partial perspective view of the vertical displacement structure according to the present invention.
Figure 16:
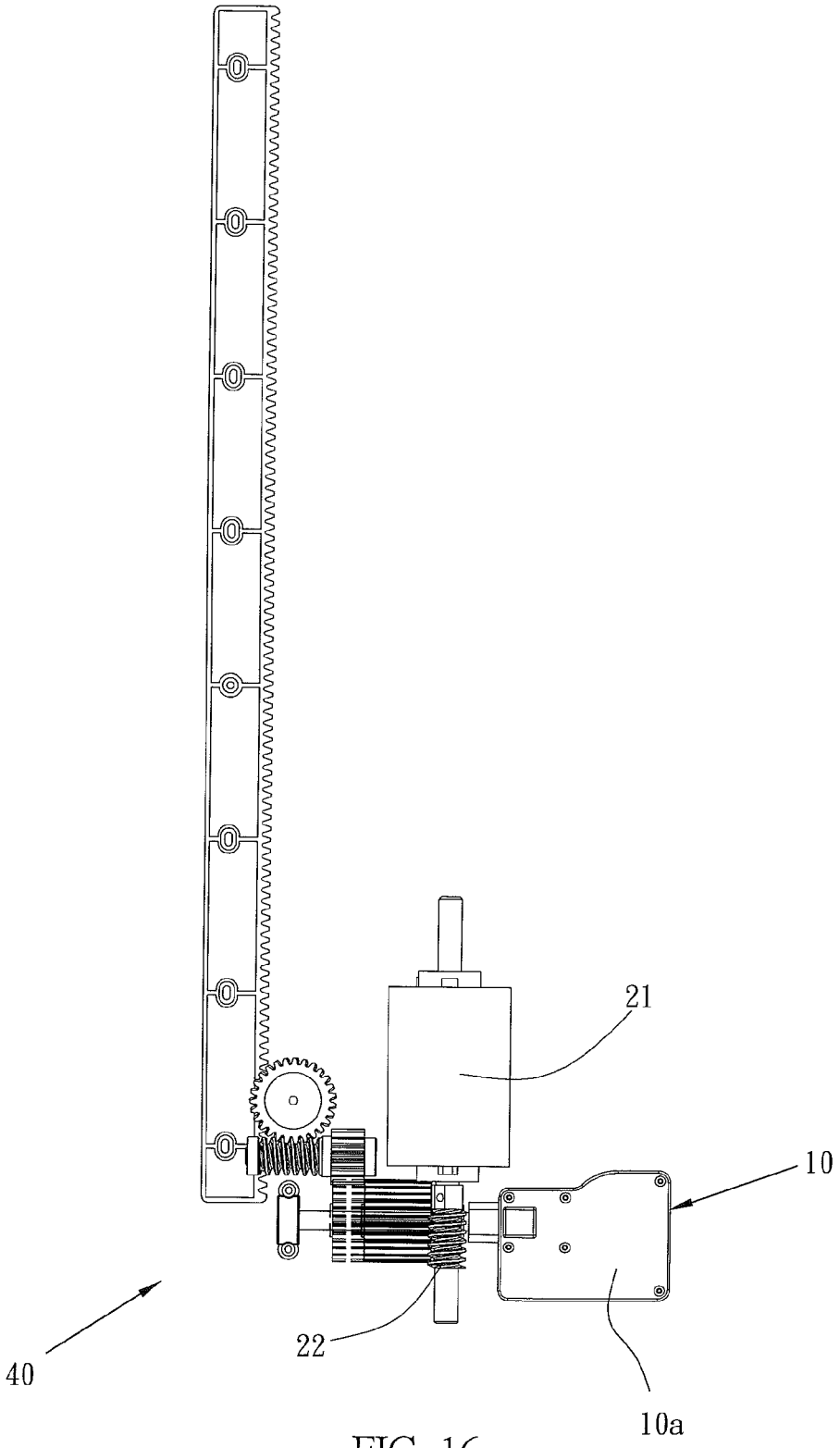
FIG. 16 is a schematic view of the operation of the first extensible device according to the present invention.

Referring to FIG. 14 through FIG. 16, the extensible device capable of switch, control, power and connection comprises a first extensible device 10*a*. The front end of the extensible transmission rod 131 of the first extensible device 10*a* is pivotally coupled to a transmission gear train 132. Two shafts are disposed at two ends of the reinforced motor 21, respectively. A first worm 22 and a second worm 23 are fixed to the two shafts, respectively. The transmission gear train 132 comprises a first input gear 1321 and a first output gear 1322. The first extensible device 10*a* is power-connected to a vertical displacement structure 40. The vertical displacement structure 40 comprises a first gear 41 and a second gear 42 which are integrally formed as well as comprises a third gear 43 and a fourth gear 44 which are integrally formed. The vertical displacement structure 40 further comprises a rack 45 fastened to a casing 30 of the massage device 20. The first input gear 1321 meshes with the first worm 22. The first extensible device 10*a* operates to allow the first output gear 1322 to mesh with the first gear 41, to allow the second gear 42 to mesh with the third gear 43, and to allow the fourth gear 44 to mesh with the rack 45. Hence, the power generated from the reinforced motor 21 is transferred to the fourth gear 44 through the transmission gear train 132, such that the fourth gear 44 rotationally meshes with the rack 45 to drive the massage device 20 to undergo vertical displacement in its entirety and instantly. Upon reverse operation of the first extensible device 10*a*, the first output gear 1322 separates from the first gear 41, such that the vertical displacement stops instantly.

Referring to FIG. 10 through FIG. 13, the extensible device capable of switch, control, power and connection further comprises a second extensible device 10*b* disposed in the direction of the second worm 23 of the reinforced motor 21. The front end of the extensible transmission rod 131 of the second extensible device 10*b* is pivotally coupled to a transmission gear train 132. The transmission gear train 132 comprises the second input gear 1323 and a second output gear 1324. A kneading structure 50 comprises a fifth gear 51 and a sixth gear 52 which are integrally formed, a seventh gear 53 fixed to a power shaft 54, and two oblique structures 55 fixed to the power shaft 54. The two oblique structures 55 each have an oblique chamber 551. The oblique chambers 551 are pivotally coupled to two massage arms 62 of four massage heads 61, respectively. The bottoms of the two massage arms 62 are connected to two tapping sticks 71, respectively, such that the two massage arms 62 and the four massage heads 61 are restricted to a swinging-based kneading massage, allowing the second output gear 1324 to mesh with the fifth gear 51, and allowing the sixth gear 52 to mesh with the seventh gear 53. The second extensible device 10*b* operates to enable the second input gear 1323 to mesh with the second worm 23. Hence, the reinforced motor 21 drives the power shaft 54 to rotate, such that a kneading massage begins instantly. Upon reverse operation of the second extensible device 10*b*, the second input gear 1323 separates from the second worm 23, such that the kneading massage stops instantly.

Referring to FIG. 10 through FIG. 13, the extensible device capable of switch, control, power and connection further comprises a third extensible device 10*c*. The third extensible device 10*c* engages with the first worm 22 from the other side. The front end of the extensible transmission rod 131 of the third extensible device 10*c* is pivotally coupled to a transmission gear train 132. The transmission gear train 132 comprises the third input gear 1325 and a third output gear 1326. The third extensible device 10*c* further comprises a tapping structure 70. The tapping structure 70 comprises an eccentric shaft 72. An eccentric head 73 is disposed at each of the two ends of the eccentric shaft 72 and is enclosed by a sleeve 74. A protruding end of the sleeve 74 is pivotally connected to one end of a corresponding one of the tapping sticks 71. The other end of the corresponding one of the tapping sticks 71 is pivotally fitted to a corresponding one of the massage arms 62 by leverage. An eighth gear 75 is fixed to the eccentric shaft 72. The eighth gear 75 meshes with the third output gear 1326. The third extensible device 10*c* operates to enable the third input gear 1325 to mesh with the first worm 22. The reinforced motor 21 operates to drive the eccentric shaft 72 to rotate and thus drive the massage heads 61 to perform a tapping massage instantly. Upon reverse operation of the third extensible device 10*c*, the third input gear 1325 separates from the first worm 22, such that the tapping massage stops instantly.

The first extensible device 10*a*, the second extensible device 10*b*, the third extensible device 10*c* each start independently. Hence, the massage device 20 is capable of undergoing vertical displacement only, capable of performing a kneading massage only, or is capable of performing a tapping massage only. The first extensible device 10*a*, the second extensible device 10*b*, and the third extensible device 10*c* can also start simultaneously, such that the massage device 20 is capable of performing vertical displacement, a kneading massage and a tapping massage simultaneously.

The first extensible device 10*a* and the second extensible device 10*b* can start simultaneously, such that the massage device 20 is capable of performing vertical displacement and a kneading massage simultaneously.

The first extensible device 10*a* and the third extensible device 10*c* can start simultaneously, such that the massage device 20 is capable of performing vertical displacement and a tapping massage simultaneously.

The second extensible device 10*b* and the third extensible device 10*c* can start simultaneously, such that the massage device 20 is capable of performing a kneading massage and a tapping massage simultaneously.

Therefore, the extensible device capable of switch, control, power and connection according to the present invention requires one reinforced motor to controllably effect a plurality of massage techniques in conjunction with the at least one extensible device, thereby having a high industrial applicability.

What is claimed is:

1. An extensible device capable of switch, control, power and connection, comprising:

at least one extensible device each comprising a signal receiving device adapted to receive a control signal and electrically connected to a small power source to control the small power source, with the at least one extensible device each having an extensible structure, wherein the extensible structure is power-connected to the small power source and has an extensible transmission rod, wherein a transmission gear train is fixed to the extensible transmission rod, wherein the small power source comprises a small motor, a small gear, one of a crank and a cam, and a lever, wherein a worm gear of the small motor drives the small gear, allowing the small gear to drive one of the crank and the cam, then allowing the crank to drive the lever, and eventually allowing the lever to drive the extensible transmission rod; and a massage device having a single reinforced motor adapted to controllably effect a plurality of massage techniques in conjunction with the at least one extensible device.

2. An extensible device capable of switch, control, power and connection, comprising:

at least one extensible device each comprising a signal receiving device adapted to receive a control signal and electrically connected to a small power source to control the small power source, with the at least one extensible device each having an extensible structure, wherein the extensible structure is power-connected to the small power source and has an extensible transmission rod, wherein a transmission gear train is fixed to the extensible transmission rod, wherein the small power source is a small motor for driving a worm drive fixed to an end of a cord, wherein another end of the cord is fixed to the extensible transmission rod, wherein the extensible transmission rod is pushed outward with a spring, wherein the small motor operates and enables the cord to be wound inward and thereby pull the extensible transmission rod inward; and a massage device having a single reinforced motor adapted to controllably effect a plurality of massage techniques in conjunction with the at least one extensible device.

3. An extensible device capable of switch, control, power and connection, comprising:

at least one extensible device each comprising a signal receiving device adapted to receive a control signal and electrically connected to a small power source to control the small power source, with the at least one extensible device each having an extensible structure, wherein the extensible structure is power-connected to the small power source and has an extensible transmission rod, wherein a transmission gear train is fixed to the extensible transmission rod, wherein the small power source comprises a solenoid valve and a solenoid valve shaft, wherein the solenoid valve operates to push and pull the solenoid valve shaft, wherein the solenoid valve shaft pushes and pulls the extensible transmission rod; and a massage device having a single reinforced motor adapted to controllably effect a plurality of massage techniques in conjunction with the at least one extensible device.

4. An extensible device capable of switch, control, power and connection, comprising:

at least one extensible device each comprising a signal receiving device adapted to receive a control signal and electrically connected to a small power source to control the small power source, with the at least one extensible device each having an extensible structure, wherein the extensible structure is power-connected to the small power source and has an extensible transmission rod, wherein a transmission gear train is fixed to the extensible transmission rod, wherein the small power source is one of a hydraulic cylinder and a pneumatic cylinder, both adapted to push and pull the extensible transmission rod; and a massage device having a single reinforced motor adapted to controllably effect a plurality of massage techniques in conjunction with the at least one extensible device.

5. An extensible device capable of switch, control, power and connection, comprising:

first, second and third extensible devices each comprising a signal receiving device adapted to receive a control signal and electrically connected to a small power source to control the small power source, wherein the small power source is power-connected to an extensible structure comprising an extensible transmission rod which a transmission gear train is fixed to; and a massage device requiring only one reinforced motor provided in a form of a twin-shaft reinforced motor with two shafts fixed to a first worm and a second worm, respectively, with the first worm flanked by the first and third extensible devices and the second worm sided by the second extensible device, allowing the first extensible device to be power-connected to a vertical displacement structure, and allowing the second extensible device to be power-connected to a kneading structure, wherein the third extensible device is power-connected to a tapping structure.

6. The extensible device of claim 5, wherein the small power source comprises a small motor, a small gear, one of a crank and a cam, and a lever, and wherein a worm gear of the small motor drives the small gear, allowing the small gear to drive one of the crank and the cam, then allowing the crank to drive the lever, and eventually allowing the lever to drive the extensible transmission rod.

7. The extensible device of claim 5, wherein the small power source is a small motor for driving a worm drive fixed to an end of a cord, wherein another end of the cord is fixed to the extensible transmission rod, wherein the extensible transmission rod is pushed outward with a spring, and wherein the small motor operates and enables the cord to be wound inward and thereby pull the extensible transmission rod inward.

8. The extensible device of claim 5, wherein the small power source comprises a solenoid valve and a solenoid valve shaft, wherein the solenoid valve operates to push and pull the solenoid valve shaft, and wherein the solenoid valve shaft pushes and pulls the extensible transmission rod.

9. The extensible device of claim 5, wherein the small power source is one of a hydraulic cylinder and a pneumatic cylinder, both adapted to push and pull the extensible transmission rod.

10. The extensible device of claim 5, wherein the vertical displacement structure comprises a first gear and a second gear which are integrally formed and further comprises a third gear and a fourth gear which are integrally formed, wherein a rack is fastened to a casing of the massage device, allowing the second gear to mesh with the third gear, allowing the fourth gear to mesh with a rack, wherein the transmission gear train comprises a first input gear and a first output gear, with the first input gear meshing with the first worm, with the first extensible device operating to enable the first output gear to mesh with the first gear such that power generated from the reinforced motor is transferred from the transmission gear train to the fourth gear such that the fourth gear rotationally meshes with the rack to drive the massage device to undergo vertical displacement in its entirety and instantly, and wherein, upon reverse operation of the first extensible device, the first output gear separates from the first gear such that vertical displacement stops instantly.

11. The extensible device of claim 5, wherein the kneading structure comprises a fifth gear and a sixth gear which are integrally formed, a seventh gear fixed to a power shaft, and two oblique structures fixed to the power shaft, wherein the two oblique structures each have an oblique chamber pivotally coupled to a corresponding one of two massage arms of four massage heads, wherein bottoms of the two massage arms are connected to two tapping sticks, respectively, such that the two massage arms and the four massage heads are restricted to a swinging-based kneading massage, wherein the transmission gear train comprises a second input gear and a second output gear, allowing the second output gear to mesh with the fifth gear, allowing the sixth gear to mesh with the seventh gear, wherein the second extensible device operates to enable the second input gear to mesh with the second worm such that the reinforced motor drives the power shaft to rotate, allowing the swinging-based kneading massage to begin instantly, and wherein, upon reverse operation of the second extensible device, the second input gear separates from the second worm such that the swinging-based kneading massage stops instantly.

12. The extensible device of claim 5, wherein the tapping structure comprises an eccentric shaft, wherein an eccentric head is disposed at each of two ends of the eccentric shaft and enclosed by a sleeve, wherein a protruding end of the sleeve is pivotally connected to an end of a corresponding one of two tapping sticks, wherein another end of the corresponding one of the two tapping sticks is pivotally fitted to a corresponding one of two massage arms of four massage heads by leverage, wherein the transmission gear train comprises a third input gear and a third output gear, wherein an eighth gear is fixed to the eccentric shaft and meshes with the third output gear, wherein the third extensible device operates to enable the third input gear to mesh with the first worm, wherein the twin-shaft reinforced motor operates to drive the eccentric shaft to rotate and thus drive the four massage heads to perform a tapping massage such that the tapping massage begins instantly, wherein, upon reverse operation of the third extensible device, the third input gear separates from the first worm such that the tapping massage stops instantly.

13. The extensible device of claim 5, wherein the first extensible device, the second extensible device, and the third extensible device each start independently such that the massage device is restricted to vertical displacement, is restricted to a kneading massage, or is restricted to a tapping massage, wherein the first extensible device, the second extensible device, the third extensible device start simultaneously such that the massage device is capable of performing the vertical displacement, the kneading massage and the tapping massage simultaneously.

14. The extensible device of claim 5, wherein the first extensible device and the second extensible device start simultaneously such that the massage device is capable of performing vertical displacement and a kneading massage simultaneously.

15. The extensible device of claim 5, wherein the first extensible device and the third extensible device start simultaneously such that the massage device is capable of performing vertical displacement and a tapping massage simultaneously.

16. The extensible device of claim 5, wherein the second extensible device and the third extensible device start simultaneously such that the massage device is capable of performing a kneading massage and a tapping massage simultaneously.

* * * * *